US011974641B2

(12) United States Patent
Li

(10) Patent No.: US 11,974,641 B2
(45) Date of Patent: May 7, 2024

(54) WRIST-WORN DEVICE AND WATCHBAND THEREOF

(71) Applicant: GOERTEK INC., Shandong (CN)

(72) Inventor: Wenjun Li, Shandong (CN)

(73) Assignee: GOERTEK INC., Shandong (CN)

( * ) Notice: Subject to any disclaimer, the term of this patent is extended or adjusted under 35 U.S.C. 154(b) by 70 days.

(21) Appl. No.: 17/788,685

(22) PCT Filed: Oct. 31, 2020

(86) PCT No.: PCT/CN2020/125627
§ 371 (c)(1),
(2) Date: Jun. 23, 2022

(87) PCT Pub. No.: WO2021/135612
PCT Pub. Date: Jul. 8, 2021

(65) Prior Publication Data

US 2023/0042111 A1 Feb. 9, 2023

(30) Foreign Application Priority Data

Dec. 31, 2019 (CN) ..... 201911411122.9

(51) Int. Cl.
*A44C 5/20* (2006.01)

(52) U.S. Cl.
CPC ..... *A44C 5/2042* (2013.01)

(58) Field of Classification Search
CPC ..... A45C 5/2042; A44C 5/2033; A44B 11/24; A44B 11/006; Y10T 24/4065
See application file for complete search history.

(56) References Cited

U.S. PATENT DOCUMENTS 4,458,390 A * 7/1984 Fogelson ..... A44B 11/12 24/182
4,765,035 A * 8/1988 Servay ..... A44B 11/006 24/265 A (Continued)

FOREIGN PATENT DOCUMENTS

CN 205229686 5/2016
CN 205233663 5/2016

(Continued)

OTHER PUBLICATIONS

International Search Report for International Application No. PCT/CN2020/125627, 13 pages, dated Jan. 7, 2021.

*Primary Examiner* — Robert Sandy
(74) *Attorney, Agent, or Firm* — HAUPTMAN HAM, LLP

(57) ABSTRACT

A watchband assembly and a wrist-worn device having the same are provided. The watchband assembly includes a watch buckle, a watchband, a buckle tongue, and a rotating shaft for mounting the buckle tongue to the watch buckle, wherein the watch buckle includes a watch buckle upper cover and a watch buckle lower cover, the watchband and the rotating shaft are both arranged between the watch buckle upper cover and the watch buckle lower cover, and a fastener penetrates the watchband and is fixedly connected to the watch buckle to press and fix the watchband to the watch buckle. The lower surface of the watch buckle upper cover and/or the watch buckle lower cover is in contact with a human body when worn, such that the surface in contact with the human body when worn is smooth.

14 Claims, 5 Drawing Sheets

(56) References Cited

U.S. PATENT DOCUMENTS

| | | | | |
|---|---|---|---|---|
| 8,365,364 | B2 * | 2/2013 | Labelson | A44B 11/006 24/316 |
| 2016/0051014 | A1 | 2/2016 | Resnick | |

FOREIGN PATENT DOCUMENTS

| | | |
|---|---|---|
| CN | 207167986 | 4/2018 |
| CN | 208274270 | 12/2018 |
| CN | 208301131 | 1/2019 |
| CN | 110916303 | 3/2020 |
| CN | 211092181 | 7/2020 |

* cited by examiner

WRIST-WORN DEVICE AND WATCHBAND THEREOF

The present application is a 371 of International Application No. PCT/CN2020/125627, titled "WRIST-WORN DEVICE AND WATCHBAND ASSEMBLY THEREOF", filed Oct. 31, 2020, which claims the benefit of and priority to Chinese Patent Application No. 201911411122.9, titled "WRIST-WORN DEVICE AND WATCHBAND ASSEMBLY THEREOF", filed with the China National Intellectual Property Administration on Dec. 31, 2019, which are incorporated herein by reference in their entireties.

FIELD

The present application relates to the technical field of wrist-worn products, and in particular to a watchband assembly. In addition, the present application further relates to a wrist-worn device comprising the above watch buckle.

BACKGROUND

In the conventional technology, as shown in FIGS. 1 and 2, a conventional watch buckle 01 and a conventional watchband 02 are connected via a rotating shaft 03, and the fixation is not firm. A watchband convex cylinder 021 configured for the rotating shaft 03 to penetrate is arranged at an end of the conventional watchband 02, and a buckle tongue 04 is rotatably arranged at the rotating shaft 03. Since the size of the watchband convex cylinder 021 is larger than the thickness of the conventional watchband 02, when the watch is worn, the watchband convex cylinder causes pressure on the wrist, which affects comfort of wearing. In addition, there is a gap between each of two sides in a width direction of the conventional watchband 02 and the conventional watch buckle 01. In a case that the gap is too small, it's difficult to assemble the conventional watch buckle 01 and the conventional watchband 02; and in a case that the gap is too large, skin may be easily pinched during rotation of the conventional watch buckle 01.

In summary, a problem to be addressed by those skilled in the art is to provide a watchband assembly which enables firm connection between the watchband and the watch buckle and improves the comfort of wearing.

SUMMARY

In view of this, an object of the present application is to provide a watchband assembly, which enables firm connection between the watch buckle and the watchband and improves comfort of wearing.

Another object of the present application is to provide a wrist-worn device including the above watchband assembly.

In order to achieve the above objects, the following technical solutions are provided according to the present application.

A watchband assembly includes a watch buckle, a watchband connected with the watch buckle, a buckle tongue rotatably arranged relative to the watch buckle, and a rotating shaft configured for mounting the buckle tongue to the watch buckle;

the watch buckle includes an upper watch buckle cover and a lower watch buckle cover that is connected with the upper watch buckle cover, and the watchband and the rotating shaft are arranged between the upper watch buckle cover and the lower watch buckle cover; and the watch buckle and the watchband are connected via a fastener, where the fastener penetrates the watchband to be fixedly connected with the watch buckle, and the watchband to the watch buckle by the fastener.

Preferably, a lower surface of the lower watch buckle cover is a smooth surface, and is lower than or flush with a lower surface of the upper watch buckle cover.

Preferably, a lower surface of the upper watch buckle cover is provided with a mounting groove, and an upper surface of the lower watch buckle cover fits with a lower surface of an edge of an opening of the mounting groove, and completely covers the opening of the mounting groove.

Preferably, a mounting portion configured for rotatably mounting the rotating shaft is arranged on a bottom surface of the mounting groove, and the rotating shaft is mounted at the mounting portion.

Preferably, the watchband is provided with a first avoidance slot for avoiding the mounting portion; and/or the lower watch buckle cover is provided with a second avoidance slot for avoiding the buckle tongue; and/or the upper watch buckle cover is provided with a third avoidance slot for avoiding the buckle tongue.

Preferably, the fastener is a screw, the upper watch buckle cover is provided with a threaded hole engaged with the screw, and a lower surface of the screw is higher than the lower surface of the lower watch buckle cover.

Preferably, the number of the screw is two, and the threaded hole includes a first threaded hole and a second threaded hole symmetrically arranged along a width direction of the upper watch buckle cover.

Preferably, the upper watch buckle cover is provided with a positioning rod, and the watchband is provided with a positioning hole matching the positioning rod.

Preferably, the positioning rod includes a first positioning rod and a second positioning rod symmetrically arranged along a width direction of the upper watch buckle cover.

A wrist-worn device includes a device body and a wearing portion for mounting the device body, where the wearing portion is the watchband assembly according to any one of the above solutions.

The watchband assembly according to the present application includes a watch buckle, a watchband connected with the watch buckle, a buckle tongue rotatably arranged relative to the watch buckle, and a rotating shaft for mounting the buckle tongue to the watch buckle; the watch buckle includes an upper watch buckle cover and a lower watch buckle cover that is connected with the upper watch buckle cover, and the watchband and the rotating shaft are arranged between the upper watch buckle cover and the lower watch buckle cover; the watch buckle and the watchband are connected via a fastener, and the fastener penetrates the watchband to be fixedly connected with the watch buckle, and the watchband is pressed and fixed to the watch buckle by the fastener.

Compared with the conventional technology, in the watchband assembly according to the present application, the watch buckle and the watchband are pressed and fastened via the fastener, and the rotating shaft and the watchband are arranged between the upper watch buckle cover and the lower watch buckle cover, which avoids providing the watchband convex cylinder. During wearing, it's the lower surface of the upper watch buckle cover and/or the lower surface of the lower watch buckle cover that in contact with the human body, so that the surface in contact with the human body is relatively flat during wearing, and the rotating shaft is arranged between the upper watch buckle cover and the lower watch buckle cover, therefore, the buckle tongue will not affect the wearer during rotation, which improves the wearing comfort. In addition, the connection using the fastener makes the watch buckle and the watchband be more firmly connected, and the watch buckle and the watchband are connected via the fastener to form an integrated structure, which enhances aesthetics of the watchband assembly.

In addition, a wrist-worn device including the above watchband assembly is provided according to the present application.

BRIEF DESCRIPTION OF THE DRAWINGS

For more clearly illustrating embodiments of the present disclosure or the technical solutions in the conventional technology, drawings referred to for describing the embodiments or the conventional technology will be briefly described hereinafter. Apparently, drawings in the following description are only a part of drawings of the present application, and for the person skilled in the art, other drawings may be obtained based on the provided drawings without any creative efforts.

In FIGS. 1-6:

| | |
|---|---|
| 01 | conventional watch buckle, |
| 02 | conventional watchband, |
| 021 | watchband convex cylinder, |
| 03 | rotating shaft, |
| 04 | buckle tongue, |
| 1 | watch buckle, |
| 11 | upper watch buckle cover, |
| 111 | third avoidance slot, |
| 12 | lower watch buckle cover, |
| 121 | second avoidance slot, |
| 13 | mounting groove, |
| 14 | first threaded hole, |
| 15 | second threaded hole, |
| 16 | mounting portion, |
| 17 | positioning rod, |
| 2 | watchband, |
| 21 | first avoidance slot, |
| 22 | positioning hole, |
| 23 | through hole, |
| 3 | screw. |

DETAILED DESCRIPTION OF THE EMBODIMENTS

Technical solutions according to the embodiments of the present application will be described as follows in conjunction with the drawings in the embodiments of the present application. It is apparent that the described embodiments are only a part of the embodiments according to the present application, rather than all of the embodiments. Any other embodiments obtained by those skilled in the art based on the embodiments in the present application without any creative work fall in the protection scope of the present application.

A core of the present application is to provide a watchband assembly, which can avoid providing the watchband convex cylinder, thereby improving the wearing comfort, and the connection using the fastener makes the watch buckle and the watchband be connected more firmly. Another core of the present application is to provide a wrist-worn device including the above watchband assembly.

Figure 1:
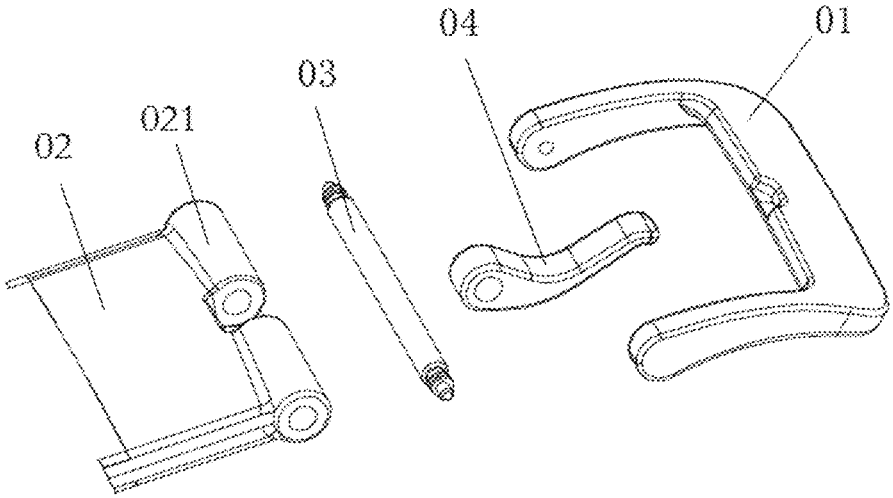
Figure 1 (prior art)
FIG. 1 is an exploded schematic view showing a watchband assembly in the conventional technology.
Figure 2:
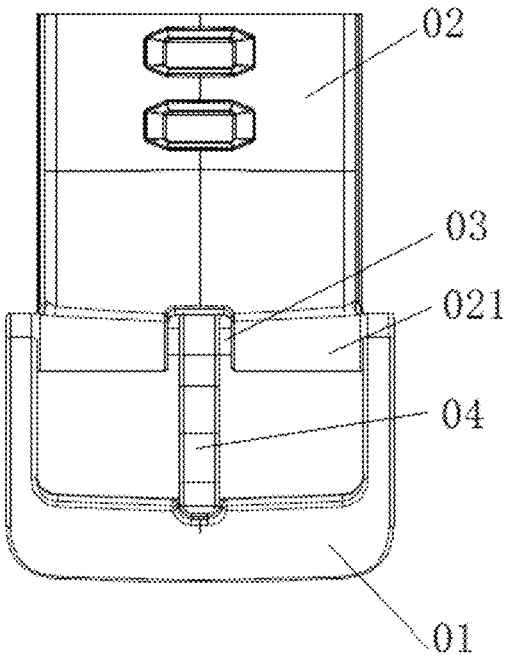
Figure 2 (prior art)
FIG. 2 is a schematic top view showing the watchband assembly of FIG. 1 in an assembled state.
Figure 3:
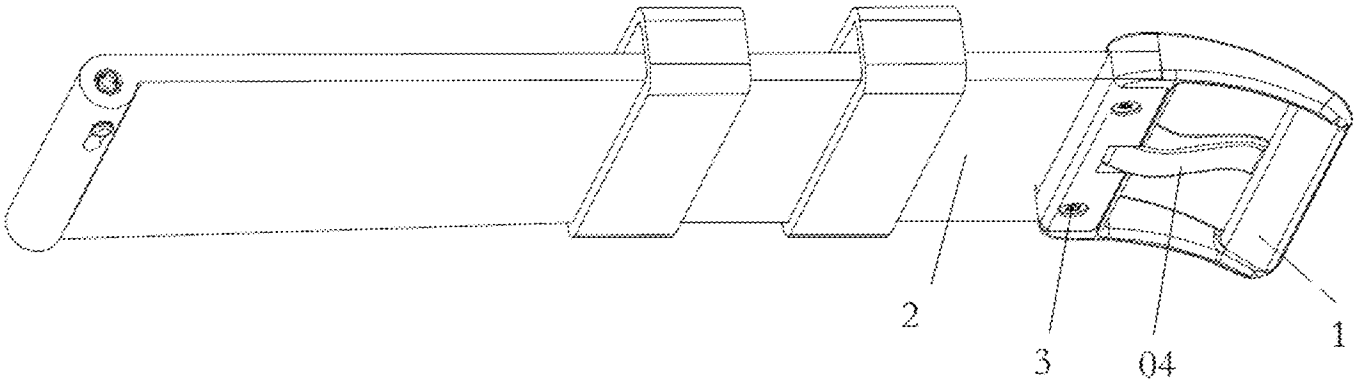
FIG. 3 is a schematic view showing the structure of a watchband assembly according to a specific embodiment of embodiments of the present application.
Figure 4:
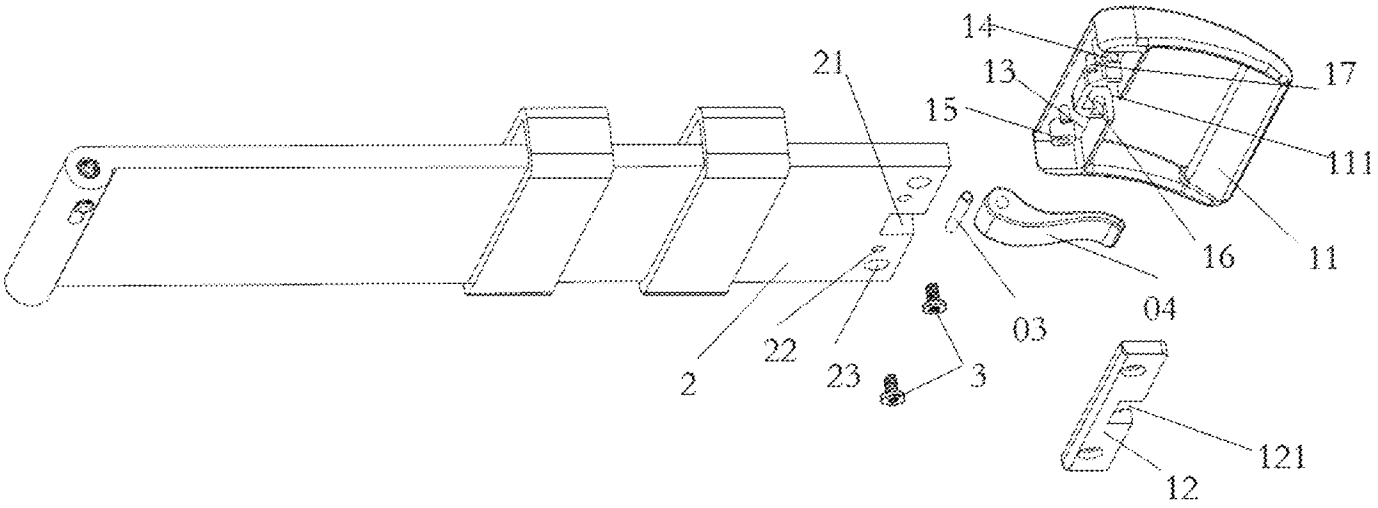
FIG. 4 is an exploded schematic view showing the watchband assembly of FIG. 3.
Figure 5:
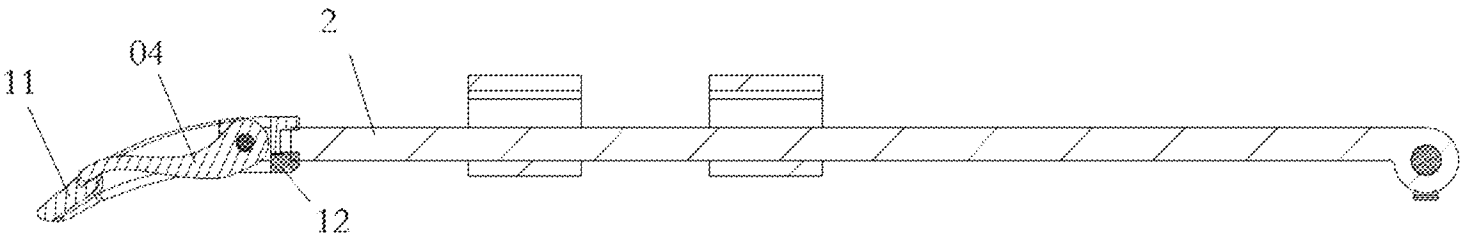
FIG. 5 is a schematic cross-sectional view taken along a longitudinal direction of the watchband assembly in FIG. 3.
Figure 6:
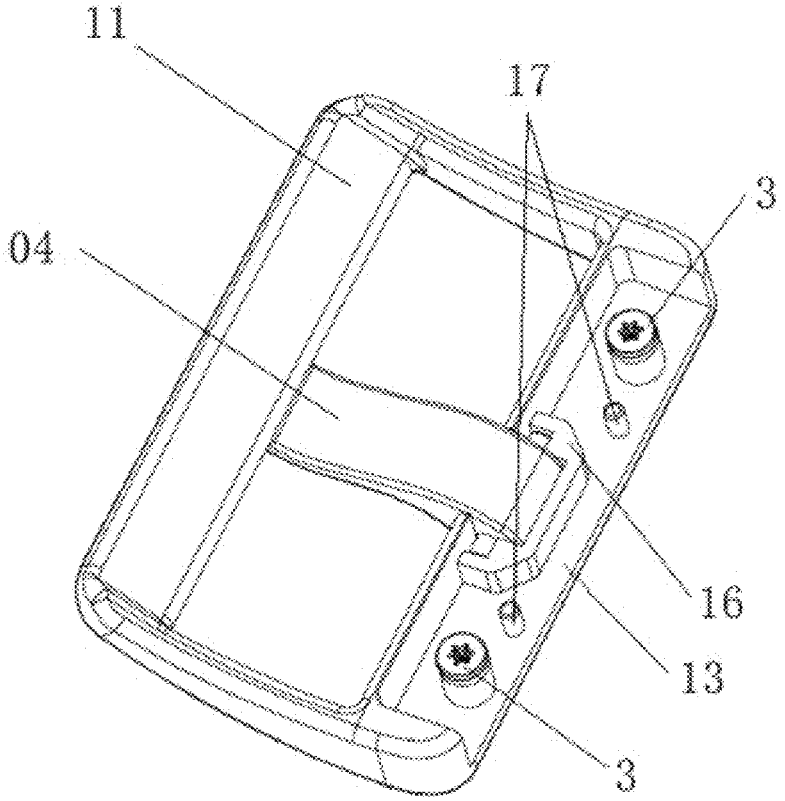
FIG. 6 is a schematic view showing the structure of part of the watchband assembly according to the embodiment of the present application.

Reference is made to FIGS. 1-6, where FIG. 1 is an exploded view showing a watchband assembly in the conventional technology; FIG. 2 is a schematic top view showing the watchband assembly of FIG. 1 in an assembled state; FIG. 3 is a schematic view showing the structure of a watchband assembly according to a specific embodiment of embodiments of the present application; FIG. 4 is an exploded schematic view showing the watchband assembly of FIG. 3; FIG. 5 is a schematic cross-sectional view taken along a longitudinal direction of the watchband assembly in FIG. 3; and FIG. 6 is a schematic view showing the structure of part of the watchband assembly according to the embodiment of the present application.

The watchband assembly according to this specific embodiment includes a watch buckle 1, a watchband 2 connected with the watch buckle 1, a buckle tongue 04 rotatably arranged relative to the watch buckle 1, and a rotating shaft 03 for mounting the buckle tongue 04 to the watch buckle 1. The watch buckle 1 includes an upper watch buckle cover 11 and a lower watch buckle cover 12 connected with the upper watch buckle cover 11, both the watchband 2 and the rotating shaft 03 are arranged between the upper watch buckle cover 11 and the lower watch buckle cover 12; and the watch buckle 1 and the watchband 2 are connected via a fastener, where the fastener penetrates the watchband 2 to be fixedly connected with the watch buckle 1, and the watchband 2 is pressed and fixed to the watch buckle 1 by the fastener.

Preferably, a lower surface of the lower watch buckle cover 12 is a smooth surface, and is lower than or flush with a lower surface of the upper watch buckle cover 11.

The upper watch buckle cover 11 and the lower watch buckle cover 12 may be directly connected via the fastener; alternatively, the watchband 2 may be pressed to the upper watch buckle cover 11, and the lower watch buckle cover 12 and the upper watch buckle cover 11 are connected in a snap-fit manner, which is determined according to an actual situation and will not be described in detail here.

It should be noted that the watchband 2 is provided with a through hole 23 for the fastener to penetrate, and the fastener penetrates the through hole 23 to be fastened to the watch buckle 1. To enable the faster to press the watchband 2 against the watch buckle 1, the fastener may be provided with a pressing portion for pressing the watchband 2 against the watch buckle 1, and a size of the pressing portion is required to be larger than a size of the through hole 23. Alternatively, a pressing member may be arranged between the fastener and the watchband 2, and the watchband 2 and the watch buckle 1 are pressed together via the pressing member.

The position and the number of the faster are determined according to the actual situation, which will not be described in detail here.

Compared with the conventional technology, in the watchband assembly according to the present specific embodiment, the watch buckle 1 and the watchband 2 are pressed and fastened via the fastener, and the rotating shaft 3 and the watchband 2 are arranged between the upper watch buckle cover 11 and the lower watch buckle cover 12, which avoids providing the watchband convex cylinder 021. During wearing, it's the lower surface of the upper watch buckle cover 11 and/or the lower surface of the lower watch buckle cover 12 that in contact with the human body, so that the surface of the watchband assembly in contact with the human body is relatively flat during wearing. Preferably, the lower surface of the lower watch buckle cover 12 is a smooth surface, and is lower than or flush with the lower surface of the upper watch buckle cover 11, the surface in contact with the human body during wearing is only the lower surface of the lower watch buckle cover 12 or a surface combined by the lower surface of the lower watch buckle cover 12 and the lower surface of the upper watch buckle cover 11, and the rotating shaft 03 is arranged between the upper watch buckle cover 11 and the lower watch buckle cover 12. Therefore, the buckle tongue 04 will not affect the wearer during rotation, which improves the wearing comfort. In addition, the connection using the fastener makes the watch buckle 1 and the watchband 2 be more firmly connected, and the watch buckle 1 and the watchband 2 are connected via the fastener to form an integrated structure, which enhances aesthetics of the watchband assembly.

On the basis of the above embodiments, the fastener may penetrate the lower watch buckle cover 12 and the watchband 2 in sequence, and then be fixedly connected to the upper watch buckle cover 11.

By providing the watch buckle 1 as a split-type structure, the watchband 2 can be arranged between the upper watch buckle cover 11 and the lower watch buckle cover 12, so that the part where the watch buckle 1 and the watchband 2 are connected has a smoother appearance, thus improving the aesthetic effect.

In order to improve the connection effect of the watchband 2 and the watch buckle 1, the lower surface of the lower watch buckle cover 12 may be provided with a mounting groove 13 for mounting the watchband 2 and the lower watch buckle cover 12. After the assembly, the lower surface of the lower watch buckle cover 12 is lower than or flush with a lower surface of an edge of an opening of the mounting groove 13.

The watch buckle 1 may be made of metal or plastic, which is determined according to the actual situation.

On the basis of the above embodiments, the fastener may be a screw 3, a threaded hole engaged with the screw 3 is provided in the upper watch buckle cover 11, and a lower surface of the screw 3 is higher than the lower surface of the lower watch buckle cover 12.

Preferably, a countersunk hole for the screw 3 to penetrate may be provided in the lower watch buckle cover 12, so that the lower surface of the screw 3 is higher than the lower surface of the lower watch buckle cover 12, to avoid injury of skin in a case that the screw 3 is protruded.

Certainly, a rubber block may further be arranged at the countersunk hole. After the screw 3 is mounted, the lower surface of the screw 3 is higher than the lower surface of the lower watch buckle cover 12, and the rubber block is arranged in the countersunk hole.

In order to improve the fixing effect of the watchband 2, the number of screw 3 may be two, and the threaded hole includes a first threaded hole 14 and a second threaded hole 15 symmetrically arranged along a width direction of the upper watch buckle cover 11, where the two screws 3 are in one-to-one correspondence with the first threaded hole 14 and the second threaded hole 15.

Preferably, two protruding cylinders may be arranged on a bottom surface of the mounting groove 13, and the two protruding cylinders are symmetrically arranged along the width direction of the upper watch buckle cover 11, the first threaded hole 14 and the first threaded hole 14 are respectively arranged in the two protruding cylinders, and a depth direction of the threaded hole is the same as a height direction of the convex cylinder.

It should be noted that the bottom surface of the mounting groove 13 mentioned in this application is a plane located in the mounting groove 13 and proximate to the upper surface of the upper watch buckle cover 11, and is opposite to the opening of the mounting groove 13 in the direction shown in FIG. 4.

On the basis of the above embodiments, in order to enable the buckle tongue 04 to be mounted smoothly, a mounting portion 16 for rotatably mounting the buckle tongue 04 may be arranged on the upper watch buckle cover 11, and the buckle tongue 04 is mounted at the mounting portion 16 via the rotating shaft 03, and the mounting portion 16 is arranged between the first threaded hole 14 and the second threaded hole 15 in the width direction of the upper watch buckle cover 11, the rotating shaft 03 is mounted at the mounting portion 16, and the mounting portion 16 is arranged in the middle in the width direction of the upper watch buckle cover 11.

In order to prevent the skin from being pinched by a mounting gap between the upper watch buckle cover 11 and the lower watch buckle cover 12, the upper surface of the lower watch buckle cover 12 may fit with the lower surface of the edge of the opening of the mounting groove 13, and the opening of the mounting groove 13 is completely covered by the lower watch buckle cover 12.

During wearing, only the lower surface of the lower watch buckle cover 12 is in contact with the human body, which can avoid the pinch.

Preferably, two sides of an outer edge of the lower watch buckle cover 12 are flush with two sides of an outer edge of the upper watch buckle cover 11.

Preferably, the mounting portion 16 is arranged on the bottom surface of the mounting groove 13, and the mounting portion 16 is closer to an inner side edge of the upper watch buckle cover 11 than the threaded hole.

As shown in FIG. 4, the upper watch buckle cover 11 is a closed rectangular loop structure, and the inner side edge refers to an inner side face of the rectangular loop structure.

The buckle tongue 04 is provided with a cylindrical hole for the rotating shaft 03 to penetrate, the mounting portion 16 is provided with a slot for matching the rotating shaft 03, and the rotating shaft 03 is rotatably mounted in the slot of the mounting portion 16.

In order to make the watchband assembly more compact, the watchband 2 may be provided with a first avoidance slot 21 for avoiding the mounting portion 16; and/or the lower watch buckle cover 12 a second avoidance slot 121 for avoiding the buckle tongue 04, and/or the upper watch buckle cover 11 may be provided with a third avoidance slot 111 for avoiding the buckle tongue 04.

Preferably, the first avoidance slot 21 is a rectangular slot, the second avoidance slot 121 is a rectangular slot, and the third avoidance slot 111 is a U-shaped slot. Sizes of the first avoidance slot 21, the second avoidance slot 121 and the third avoidance slot 111 are required to be determined according to a rotation angle of the buckle tongue 04 and the size and the mounting position of the buckle tongue 04, which will not be described in detail here.

Preferably, the mounting portion 16 is symmetrically arranged in the width direction of the upper watch buckle cover 11.

On the basis of the above embodiments, in order that the watchband 2 is positioned and mounted relative to the upper watch buckle cover 11, a positioning rod 17 may be arranged on the upper watch buckle cover 11, and a positioning hole 22 for matching the positioning rod 17 may be provided in the watchband 2.

Preferably, the positioning rod 17 is cylindrical-shaped.

As shown in FIG. 4, the number of the positioning rod 17 is two, including a first positioning rod and a second positioning rod, and the two positioning rods 17 are arranged on the bottom surface of the mounting groove 13, and are symmetrically arranged along the width direction of the upper watch buckle cover 11; in the width direction of the upper watch buckle cover 11, the two positioning rods 17 are arranged between the two threaded holes.

During the assembly, the rotating shaft 03 penetrates the buckle tongue 04 to rotatably mount the whole buckle tongue 04 at the mounting portion 16, and the positioning hole 22 in the watchband 2 matches the positioning rod 17 on the upper watch buckle cover 11, to press the lower watch buckle cover 12 against the watchband 2, and then the two screws 3 penetrates the lower watch buckle cover 12 and the watchband 2 to connect with the first threaded hole 14 and the second threaded hole 15 respectively, and the screws 3 are tightened to fasten the watchband 2.

In addition to the above watchband assembly, a wrist-worn device including the watchband assembly disclosed in the above embodiments is further provided according to the present application, the wrist-worn device includes a device body and a wearing portion for mounting the device body, and the wearing portion is the watchband assembly according to any one of the above solutions. For the structure of the other parts of the wrist-worn device, reference may be made to the conventional technology, which will not be repeated here.

The wrist-worn device may be a device such as a watch, a smart bracelet or the like, of course, may also be other wrist-worn products, which is determined according to the actual situation, and will not be described in detail here.

It should be noted that the "upper" and "lower" mentioned in this application are described by taking the directions shown in FIGS. 3, 4 and 5 as examples. When the orientation of the watchband assembly is changed, the described orientation may be adjusted accordingly.

It should be noted that the "first", "second" and "third" in the first threaded hole 14, the second threaded hole 15, the first avoidance slot 21, the second avoidance slot 121, and the third avoidance slot 111 mentioned in this application are only intended to distinguish the different positions, which does not refers to order of precedence.

The above embodiments in this specification are described in a progressive manner. Each of the embodiments is mainly focused on describing its differences from other embodiments, and reference may be made among these embodiments with respect to the same or similar parts. Any combination of all the embodiments according to the present application falls within the protection scope of the present application, which will not be repeated here.

The wrist-worn device and the watchband assembly thereof according to the present application are introduced in detail. Principles and embodiments of the present application are described herein through specific examples. Description of the above embodiments is merely used to facilitate understanding the method and concept of the present application. It should be noted that several improvements and modifications can be made to the present application by those skilled in the art without departing from the principles of the present application. These improvements and modifications shall fall within the scope of the claims of the present application.

The invention claimed is:

1. A watchband assembly, comprising:

a watch buckle, a watchband connected with the watch buckle, a buckle tongue rotatably arranged relative to the watch buckle, and a rotating shaft configured for mounting the buckle tongue to the watch buckle; wherein the watch buckle comprises an upper watch buckle cover and a lower watch buckle cover connected with the upper watch buckle cover, and the watchband and the rotating shaft are arranged between the upper watch buckle cover and the lower watch buckle cover; and the watch buckle and the watchband are connected via a fastener, wherein the fastener penetrates the watchband to be fixedly connected with the watch buckle, and the watchband is pressed and fixed to the watch buckle by the fastener;

a lower surface of the lower watch buckle cover is a smooth surface, and is lower than or flush with a lower surface of the upper watch buckle cover.

2. The watchband assembly according to claim 1, wherein the fastener is a screw, the upper watch buckle cover is provided with a threaded hole engaged with the screw, and a lower surface of the screw is higher than a lower surface of the lower watch buckle cover.

3. The watchband assembly according to claim 2, wherein the number of the screw is two, and the threaded hole comprises a first threaded hole and a second threaded hole symmetrically arranged along a width direction of the upper watch buckle cover.

4. The watchband assembly according to claim 1, wherein the upper watch buckle cover is provided with a positioning rod, and the watchband is provided with a positioning hole matching the positioning rod.

5. A watchband assembly, comprising:

a watch buckle, a watchband connected with the watch buckle, a buckle tongue rotatably arranged relative to the watch buckle, and a rotating shaft configured for mounting the buckle tongue to the watch buckle; wherein the watch buckle comprises an upper watch buckle cover and a lower watch buckle cover connected with the upper watch buckle cover, and the watchband and the rotating shaft are arranged between the upper watch buckle cover and the lower watch buckle cover, the watch buckle and the watchband are connected via a fastener, wherein the fastener penetrates the watchband to be fixedly connected with the watch buckle, and the watchband is pressed and fixed to the watch buckle by the fastener, and wherein a lower surface of the upper watch buckle cover is provided with a mounting groove, and an upper surface of the lower watch buckle cover fits with a lower surface of an edge of an opening of the mounting groove, and completely covers the opening of the mounting groove.

6. The watchband assembly according to claim 5, wherein a mounting portion configured for rotatably mounting the rotating shaft is arranged on a bottom surface of the mounting groove, and the rotating shaft is mounted at the mounting portion.

7. The watchband assembly according to claim 6, wherein the watchband is provided with a first avoidance slot for avoiding the mounting portion; and/or the lower watch buckle cover is provided with a second avoidance slot for avoiding the buckle tongue; and/or the upper watch buckle cover is provided with a third avoidance slot for avoiding the buckle tongue.

8. The watchband assembly according to claim 6, wherein the upper watch buckle cover is provided with a positioning rod, and the watchband is provided with a positioning hole matching the positioning rod.

9. A wrist-worn device, comprising:

a device body; and a wearing portion for mounting the device body, wherein the wearing portion is the watchband assembly according to claim 6.

10. The watchband assembly according to claim 5, wherein the upper watch buckle cover is provided with a positioning rod, and the watchband is provided with a positioning hole matching the positioning rod.

11. A wrist-worn device, comprising:

a device body; and a wearing portion for mounting the device body, wherein the wearing portion is the watchband assembly according to claim 5.

12. A watchband assembly, comprising:

a watch buckle, a watchband connected with the watch buckle, a buckle tongue rotatably arranged relative to the watch buckle, and a rotating shaft configured for mounting the buckle tongue to the watch buckle; wherein the watch buckle comprises an upper watch buckle cover and a lower watch buckle cover connected with the upper watch buckle cover, and the watchband and the rotating shaft are arranged between the upper watch buckle cover and the lower watch buckle cover, the watch buckle and the watchband are connected via a fastener, wherein the fastener penetrates the watchband to be fixedly connected with the watch buckle, and the watchband is pressed and fixed to the watch buckle by the fastener, and wherein the upper watch buckle cover is provided with a positioning rod, and the watchband is provided with a positioning hole matching the positioning rod.

13. The watchband assembly according to claim 12, wherein the positioning rod comprises a first positioning rod and a second positioning rod symmetrically arranged along a width direction of the upper watch buckle cover.

14. A wrist-worn device, comprising:

a device body; and a wearing portion for mounting the device body, wherein the wearing portion is the watchband assembly according to claim 1.

* * * * *